US011642637B2

(12) United States Patent
Andersson et al.

(10) Patent No.: US 11,642,637 B2
(45) Date of Patent: May 9, 2023

(54) VANE FOR AN IMPELLER OF AN AGITATOR, IMPELLER AND AGITATOR

(71) Applicant: Sulzer Management AG, Winterthur (CH)

(72) Inventors: Mikael Andersson, Gothenburg (SE); Erik Blechingberg, Gothenburg (SE)

(73) Assignee: SULZER MANAGEMENT AG, Winterthur (CH)

( * ) Notice: Subject to any disclaimer, the term of this patent is extended or adjusted under 35 U.S.C. 154(b) by 203 days.

(21) Appl. No.: 17/065,721

(22) Filed: Oct. 8, 2020

(65) Prior Publication Data

US 2021/0023515 A1 Jan. 28, 2021

Related U.S. Application Data

(63) Continuation of application No. 15/433,383, filed on Feb. 15, 2017, now Pat. No. 10,835,879.

(30) Foreign Application Priority Data

Mar. 1, 2016 (EP) ..... 16158040

(51) Int. Cl.
*B01F 27/00* (2022.01)
*B01F 27/113* (2022.01)
(Continued)

(52) U.S. Cl.
CPC ..... *B01F 27/113* (2022.01); *B01F 27/071* (2022.01); *B01F 27/1133* (2022.01);
(Continued)

(58) Field of Classification Search
CPC ..... B01F 2101/47; B01F 2215/0431; B01F 27/071; B01F 27/113; B01F 27/1133; B01F 27/71; B01F 33/86
See application file for complete search history.

(56) References Cited

U.S. PATENT DOCUMENTS 123,274 A 1/1872 McCay
390,615 A 10/1888 Nye
(Continued)

FOREIGN PATENT DOCUMENTS

DE 102013018690 A1 5/2015
EP 0284929 A1 10/1988
(Continued)

OTHER PUBLICATIONS

Extended European Search Report dated Feb. 1, 2017 in corresponding EP Patent Application No. 16158040.2, filed Mar. 1, 2016.
(Continued)

*Primary Examiner* — Anshu Bhatia
(74) *Attorney, Agent, or Firm* — Global IP Counselors, LLP

(57) ABSTRACT

A vane for an impeller of an agitator includes a socket having a base plane configured to mount the vane to an impeller, and a blade configured to mix a process fluid, the blade having a leading edge, a trailing edge, and a blade tip extending from the leading edge to the trailing edge at an end of the blade facing away from the socket, the blade having a pressure side and a suction side, and the pressure side having a first concave region towards the leading edge, a second concave region toward the trailing edge and a convex region between the first and second concave regions.

11 Claims, 10 Drawing Sheets

(51) Int. Cl.

| | |
|---|---|
| ***B01F 27/71*** | (2022.01) |
| ***B01F 27/07*** | (2022.01) |
| ***B01F 33/00*** | (2022.01) |
| *B01F 101/47* | (2022.01) |

(52) U.S. Cl.
CPC ..... *B01F 27/71* (2022.01); *B01F 33/86* (2022.01); *B01F 2101/47* (2022.01); *B01F 2215/0431* (2013.01)

(56) References Cited

U.S. PATENT DOCUMENTS

| | | | | | |
|---|---|---|---|---|---|
| 1,634,330 | A | | 7/1927 | Malm | |
| 1,839,126 | A | * | 12/1931 | Sperry | F04D 29/225 415/70 |
| 2,072,322 | A | | 12/1935 | Upson | |
| 2,460,902 | A | | 2/1949 | Odor | |
| 4,721,394 | A | | 1/1988 | Casto et al. | |
| 5,249,993 | A | * | 10/1993 | Martin | B63H 1/26 416/223 R |
| 5,326,226 | A | | 7/1994 | Wyczalkowski et al. | |
| 5,611,665 | A | | 3/1997 | Angel | |
| 5,954,474 | A | * | 9/1999 | Fisher, Jr. | F03B 11/04 415/24 |
| 2002/0182080 | A1 | * | 12/2002 | Lin | B63H 3/002 416/209 |
| 2016/0289622 | A1 | | 10/2016 | Czwaluk | |

FOREIGN PATENT DOCUMENTS

| | | | |
|---|---|---|---|
| EP | 2497709 | A1 | 9/2012 |
| GB | 2475008 | A | 5/2011 |
| KR | 101506630 | B1 | 3/2015 |

OTHER PUBLICATIONS

Michigan Wheel Engineering, Grand Rapids, MI 49507 USA "World Leaders in Propulsion and Marine Maneuverability Stems", Propeller Geometry, Aug. 31, 2000, pp. 1-18.

Tom Benson, "Wing Geometry Definitions" Glenn Research Center, NASA Glenn Learning Technologies, URL <https://web.archive.org>, Nov. 15, 2018, pp. 1-3.

Main Propulsion Power Plant, Dalian Maritime University Press, Jun. 30, 2021, 6 pages (with Partial English Translation).

* cited by examiner

VANE FOR AN IMPELLER OF AN AGITATOR, IMPELLER AND AGITATOR

CROSS-REFERENCE TO RELATED APPLICATION

This application is a continuation application of U.S. patent application Ser. No. 15/433,383, filed Feb. 15, 2017, which claims priority to European Application No. 16158040.2, filed Mar. 1, 2016, the contents of each of which is hereby incorporated herein by reference.

BACKGROUND

Field of the Invention

The invention relates to a vane for an impeller of an agitator for mixing or agitating a process fluid. The invention further relates to an impeller of an agitator comprising such vanes as well as to an agitator having such an impeller.

Background of the Invention

Agitators are used in many different industrial processes for mixing or agitating a process fluid. In most applications, the process fluid is contained in a tank or a tower or another vessel and the agitator is mounted to a wall or the bottom or the cover of the vessel. Amongst the wide range of industries where agitators are used is, for example, the pulp and paper industry. Here, agitators are used for example for dilution, mixing or bleaching processes.

Basically an agitator comprises an impeller or propeller for agitating the fluid, a shaft which is connected at one end to the impeller and at another end to a drive unit for rotating the shaft with the impeller. The drive unit usually has a motor and a coupling for connecting the motor with the shaft, wherein the coupling comprises a belt drive or a gear box or any other suited transmission device.

Typically the drive unit is arranged outside of the vessel and the shaft with the impeller is located inside the vessel for agitating the process fluid. There are known both top-mounted and side-mounted agitators. Top-mounted agitators are usually mounted to the cover or the top part of the tower or the vessel with the shaft of the agitator extending vertically. Side-mounted agitators are usually mounted to a side wall of the tower or the vessel with the shaft extending horizontally. Examples for both types of agitators are those which are sold by the applicant under the brands SALOMIX™ and SCABA™.

SUMMARY

In modern industrial processes there is a demand for highly efficient mixing and agitation solutions. Especially a minimal power consumption, a reliable operation and an optimum process result are desired. In addition, it is often requested that an agitator is quite flexible with respect to its use, i.e. the agitator shall be adaptable to different processes or process conditions, for example to different or changing compositions of the respective process fluid.

Therefore, it is an object of the invention to propose a new vane for an impeller of an agitator for mixing or agitating a process fluid, providing a high agitating efficiency, a reliable operation and flexibility with respect to the adaption to different applications. In addition, it is an object of the invention to propose a corresponding impeller for an agitator as well as a new agitator having such an impeller.

The subject matter of the invention satisfying this object is characterized by the features described herein.

Thus, according to the invention a vane for an impeller of an agitator for mixing or agitating a process fluid is proposed, comprising a socket for mounting the vane to an impeller and a blade for mixing or agitating the process fluid, the blade being connected to the socket, the blade having a leading edge, a trailing edge, and a blade tip extending from the leading edge to the trailing edge at the end of the blade facing away from the socket, and the blade having a height and a width, wherein the height is the maximum distance of the blade tip from the socket and wherein the width is the distance of the leading edge from the trailing edge, wherein the blade has a maximum width that is at least 55 percent, preferably at least 65 percent of the height.

This new design of the blade, and especially the considerably large width of the blade as compared to its height, results in a very high efficiency regarding the mixing or agitating action combined with a reliable and very good result of the mixing or agitating.

In addition, since the vane comprises a socket for mounting the vain to an impeller, the vane according to the invention is very flexible in view of adapting the vane to different or changing conditions of the process fluid. Because the vane is designed such that it is detachable from an impeller it may be easily replaced or fixed in another orientation with respect to a hub of an impeller.

Especially in view of a very high efficiency for many applications such embodiments are preferred in which the maximum width is at least 70 percent, preferably at least 75 percent of the height.

The width of the blade typically changes from the socket in direction to the blade tip. In view of a high efficiency it is a further preferred measure, when the maximum width of the blade is located in a region between 40 percent and 70 percent of the height of the blade, preferably in a region between 50 percent and 60 percent of the height. Thus, starting at the socket and moving in direction to the blade tip the width of the blade is first increasing until it reaches the maximum width in the region. Further moving towards the blade tip the width of the blade is preferably decreasing.

It is an additional advantageous measure in view of high efficiency, when the leading edge extends from the socket to the blade tip with a main curvature that is larger as a main curvature with which the trailing edge extends from the socket to the blade tip. The term "main curvature" can be used to indicate that the curvature both of the leading edge and of the trailing edge is not constant but changes along the respective edge. However, especially in the region where the blade has its maximum width the curvature of the leading edge and the curvature of the trailing edge may be approximated by a respective constant curvature, for example by a respective circle. The radius of the circle can be then considered as the main curvature of the respective edge.

According to an embodiment of the vane in accordance with the invention, the main curvature of the trailing edge has a radius that is at least 1.5 times, preferably at least 1.8 times, a radius of the main curvature of the leading edge.

According to a preferred embodiment of the vane, the blade is connected to the socket in a base plane and has a main axis extending perpendicular to the base plane in direction to the blade tip, wherein the blade is twisted around the main axis.

Preferably this twisting of the blade is realized such that the mean direction of a camber line of a profile of the blade parallel to the base plane is turning around the main axis with increasing distance from the base plane.

In a preferred embodiment of the vane, the mean direction of the camber line of a profile near the base plane and the mean direction of the camber line of a profile near the blade tip extend with a twist angle of at least 30° with respect to each other.

The twisting of the blade around the main axis is advantageous with respect to a high mixing or agitating efficiency of the vane.

In view of a high flexibility regarding the adaption to different applications or to changing properties of the process fluid it is a preferred measure when the socket is designed as a flange socket for flange mounting the vane to a hub.

In addition, according to the invention an impeller of an agitator for mixing or agitating a process fluid is proposed comprising a hub and a plurality of vanes mounted to the hub, wherein each vane is designed according to the invention and each vane is mounted to the hub by the respective socket. The impeller has a high mixing or agitating efficiency and provides reliable, very good process results.

Preferably each vane is adjustably mounted to the hub. By this measure the impeller may be adapted in a very easy manner to different applications or different conditions of the process fluid.

According to a preferred embodiment the impeller has three vanes.

According to yet a further aspect of the invention an agitator for mixing or agitating a process fluid is proposed comprising an impeller for agitating or mixing the process fluid, a drive unit for rotating the impeller, and a drive shaft connecting the impeller with the drive unit, wherein the impeller is designed according to the invention. This agitator ensures a high efficiency, reliable operation and very good process results in combination with a low energy consumption. In addition, the agitator may be adapted in a very easy manner to a lot of different applications.

According to a preferred embodiment, the agitator has a mounting flange for fastening the agitator to a wall of a vessel for the process fluid, wherein the drive shaft comprises an inner shaft and a sleeve coaxially surrounding the inner shaft and extending between the hub of the impeller and the mounting flange, wherein the sleeve is designed in such a manner that the sleeve prevents the inner shaft from a contact with the process fluid when the agitator is mounted to the wall of the vessel. By providing the drive shaft with the protecting sleeve it is possible to use a cost-efficient inner shaft wherein this inner shaft is protected against aggressive process fluids or against corrosion and/or wear by the sleeve.

According to an embodiment the agitator is designed for being mounted horizontally to a wall of a vessel for the process fluid. However, the agitator may also be designed for other types of mounting it to a vessel, a tower, a tank or the like.

Further advantageous measures and embodiments of the invention will become apparent from the description herein.

BRIEF DESCRIPTION OF THE DRAWINGS

The invention will be explained in more detail hereinafter with reference to the drawings.

DETAILED DESCRIPTION OF THE EMBODIMENTS

Figure 1:
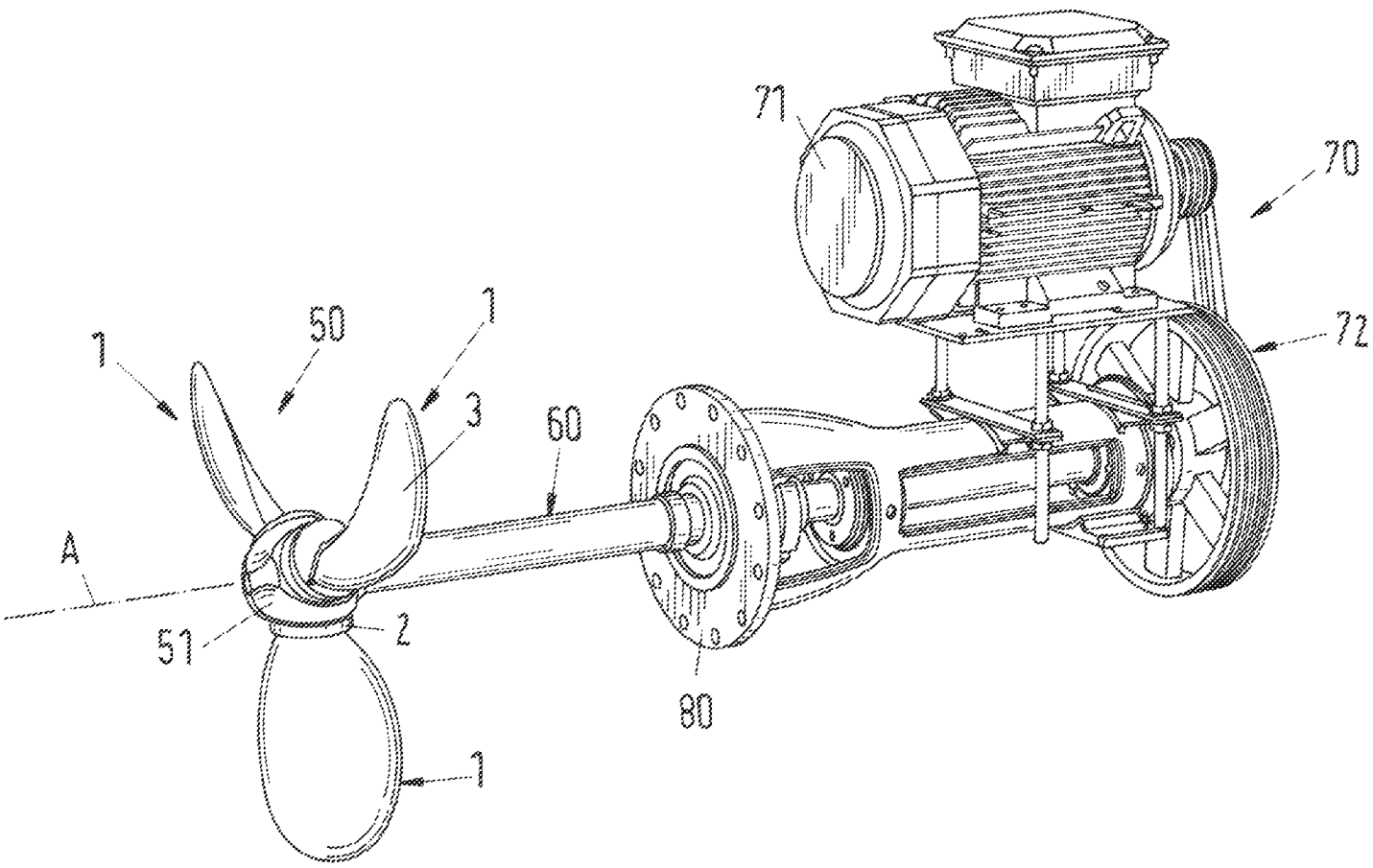
FIG. 1 is a perspective view of an embodiment of an agitator according to the invention.

For the sake of a better understanding, firstly the general setup of an agitator will be explained referring to FIG. 1. FIG. 1 shows a perspective view of an embodiment of an agitator according to the invention which is designated in its entity with reference numeral 100. The agitator comprises an impeller 50 having a hub 51 and three vanes 1, each of which has a socket 2 for mounting the respective vane 1 to the hub 51 as well as a blade 3 connected to the socket 2 for agitating or mixing a process fluid. Both the impeller 50 and each vane 1 are designed as embodiments of the impeller or the vane, respectively, according to the invention, which will be explained in more detail hereinafter.

The hub 51 of the impeller 50 is connected to an end of a drive shaft 60. The other end of the drive shaft 60 is operatively connected to a drive unit 70 for rotating the drive shaft 60 and the impeller 50 connected therewith around an axis A. The drive unit 70 comprises a motor 71, for example an electric motor 71, and a coupling 72 for operatively connecting the motor 71 with the drive shaft 60.

The coupling 72 shown in FIG. 1 has a belt drive for connecting the motor 71 to the drive shaft 60. It goes without saying that the invention is not restricted to such a belt drive. The drive unit 70 of an agitator 100 according to the invention may also be designed with any other coupling 72 between the motor 71 and the drive shaft 60 known in the art, for example with a gear box or any other suited transmission device. In addition, the relative arrangement of the motor 71, the coupling 72 and the drive shaft 60 shown in FIG. 1 shall be understood exemplary. There are many other arrangements known in the art that are also suited for the agitator according to the invention.

The embodiment of the agitator 100 shown in FIG. 1 is designed as a side-mounted agitator and designed for being mounted horizontally to a wall of a vessel, a tank, a tower, a container or any other receptacle, i.e. the drive shaft 60 is extending horizontally in the usual orientation of use of the agitator 100. Although this is a preferred embodiment for the agitator 100 according to the invention, the invention is not restricted to side-mounted or horizontal agitators. An agitator according to the invention may also be designed for example as a top-mounted or vertical agitator, i.e. with the drive shaft extending vertically in the usual orientation of use.

The side-mounted agitator 100 shown in FIG. 1 has a mounting flange 80 for fastening the agitator to a wall of a vessel, tank, tower or the like. The mounting flange 80 surrounds the drive shaft 60 concentrically and comprises several bores for receiving screws or bolts for fastening the agitator 100 to the wall. When the agitator 100 is mounted to the wall, the mounting flange 80, the impeller 50 and the part of the shaft drive 60 between the mounting flange 80 and the impeller 50 are located within the vessel, the tank, the tower or the like containing the process fluid to be agitated or mixed by the impeller 50. Further details of the agitator 100 such as seals and bearings are well known to the skilled person and therefore will not be described in more detail.

Figure 2:
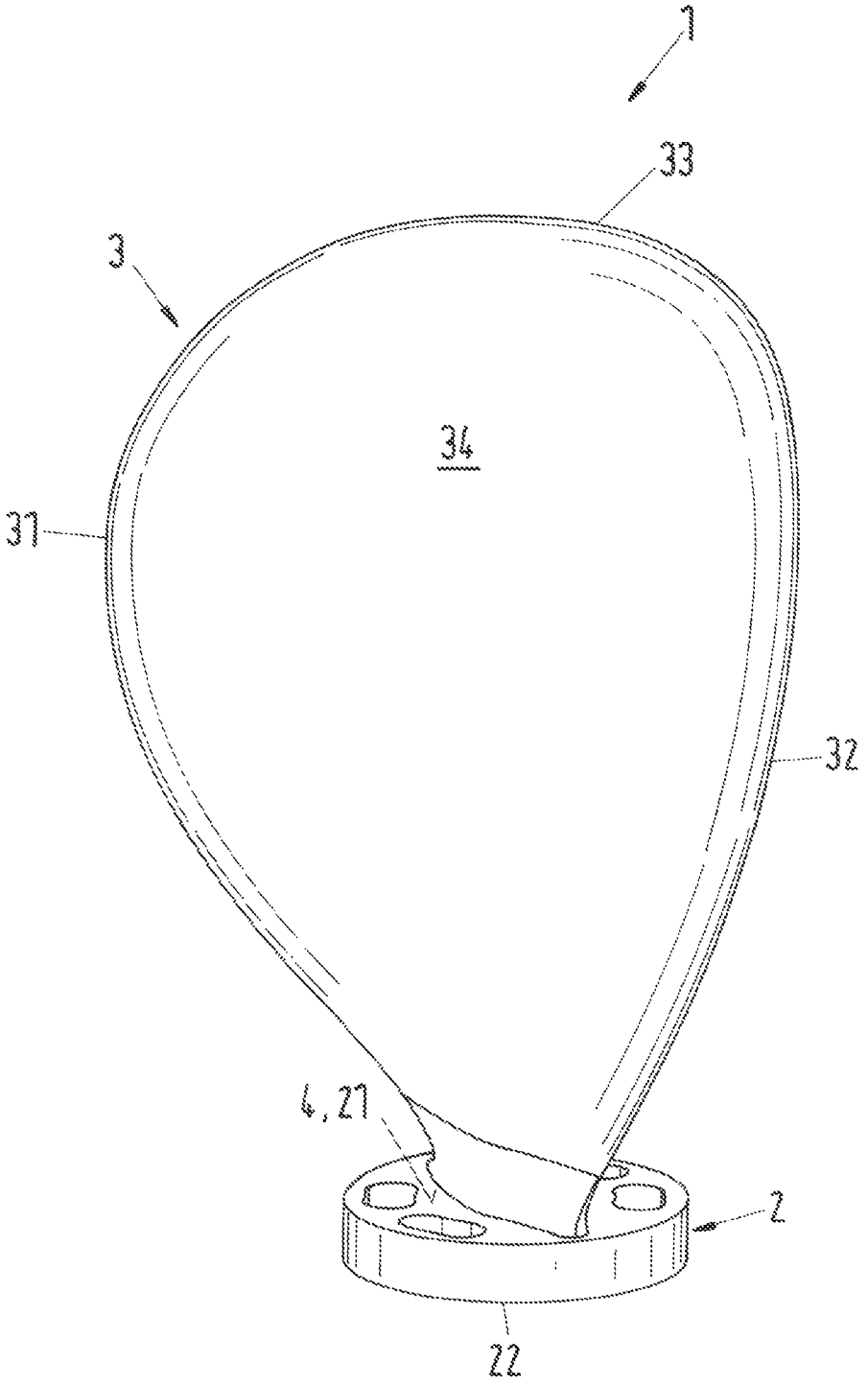
FIG. 2 is a perspective view of an embodiment of a vane according to the invention.
Figure 3:
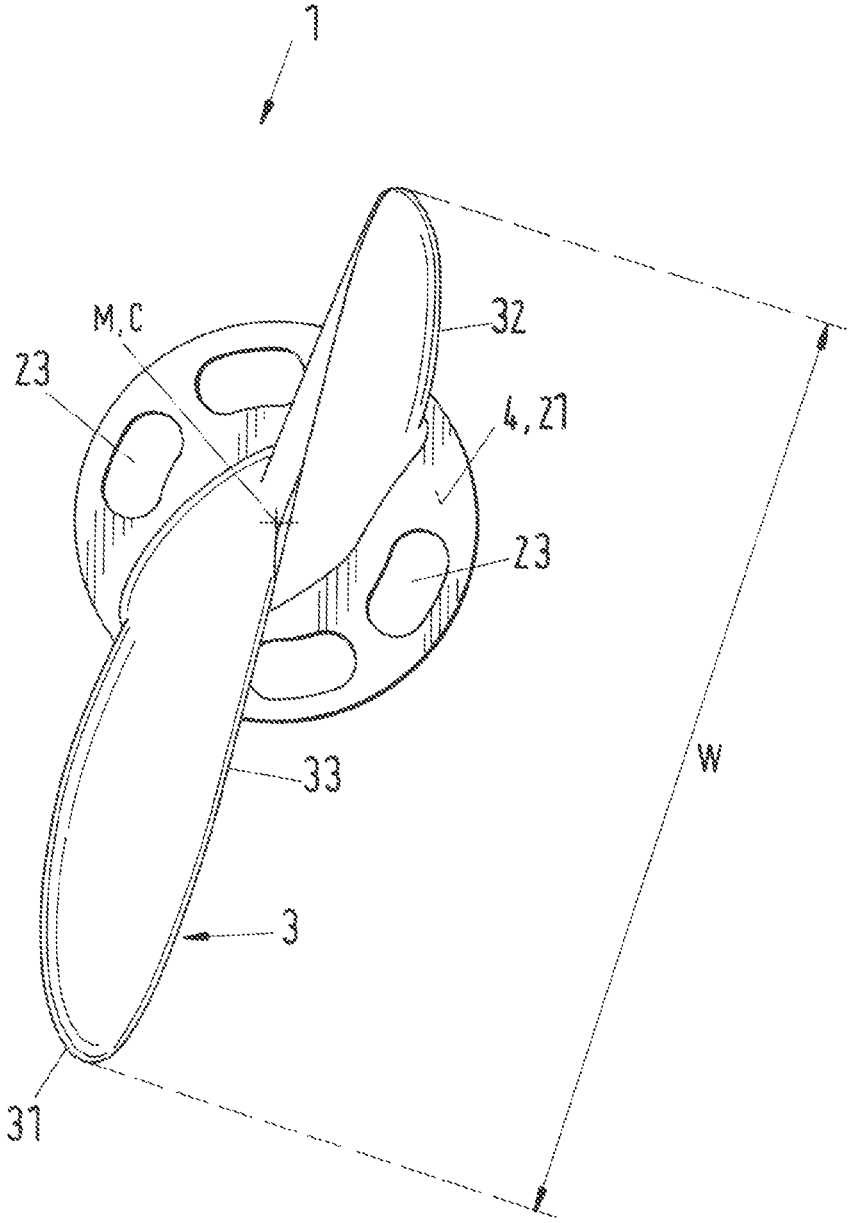
FIG. 3 is a top view of the embodiment of the vane shown in FIG. 2.

Turning now to the vane 1, an embodiment of a vane 1 according to the invention will be explained referring to FIG. 2-FIG. 5. FIG. 2 shows an overall perspective view of an embodiment of the vane 1 according to the invention. FIG. 3 is a top view of this embodiment of the vane 1, FIG. 4 a plan view of a suction side of the vane and FIG. 5 is a bottom view of the vane 1.

The vane 1 comprises the socket 2 for mounting the vane 1 to an impeller and the blade 3 for mixing or agitating a process fluid. The blade 3 is connected to the socket 2, for example by welding or by any other suited process. Of course, the blade 3 and the socket 2 may also be manufactured as a single piece, i.e. the blade 3 may be formed integrally with the socket 2 as a single piece.

The socket 2 is disc shaped in the form of a cylinder with a plane lower surface 22 and a plane upper surface 21 to which the blade 3 is connected. The upper surface 21 to which the blade 3 is joined defines a base plane 4, i.e. the base plane 4 is that plane that comprises the upper surface 21. The center of the upper surface 21 is denoted with C.

The blade 3 is extending in a direction perpendicular to the base plane 4 and has a leading edge 31, a trailing edge 32 and a blade tip 33 extending from the leading edge 31 to the trailing edge 32 at the end of the blade 3 that faces away from the socket 2. The blade 3 has two surfaces each extending from the leading edge 31 to the trailing edge 32, namely a pressure side 34 and a suction side 35 (see FIG. 4).

It shall be understood that the terms "leading edge", "trailing edge", "pressure side", "suction side" and the like respectively refer to the operational state, when the vane 1 is mounted to the impeller 50 of the agitator 100.

The blade 3 extends along a main axis M, which is that axis perpendicular to the base plane 4 on which the center C of the upper surface 21 is located.

The blade 3 has a height H (see FIG. 4) which is the maximum distance of the blade tip 33 from the upper surface 21 of the socket 2, i.e. the maximum perpendicular distance of the blade tip 33 from the base plane 4. The blade 3 has a width W, defined as the shortest distance of the leading edge 31 from the trailing edge 32 measured in a direction perpendicular to the main axis M. Thus, the width W at a given distance D from the base plane 4 is measured in a plan view of the suction side 35 (or the pressure side 34) as the length of a straight line parallel to the base plane 4, which connects a point L on the leading edge 31 with a point T on the trailing edge 32, whereas the points L and T have the same perpendicular distance D from the base plane 4.

In the top view shown in FIG. 3 the width W of the blade 3 at a given distance D from the base plane 4 is the shortest distance of the leading edge 31 from the trailing edge 32 measured in a direction parallel to the base plane 4 and perpendicular to the main axis M.

Figure 4:
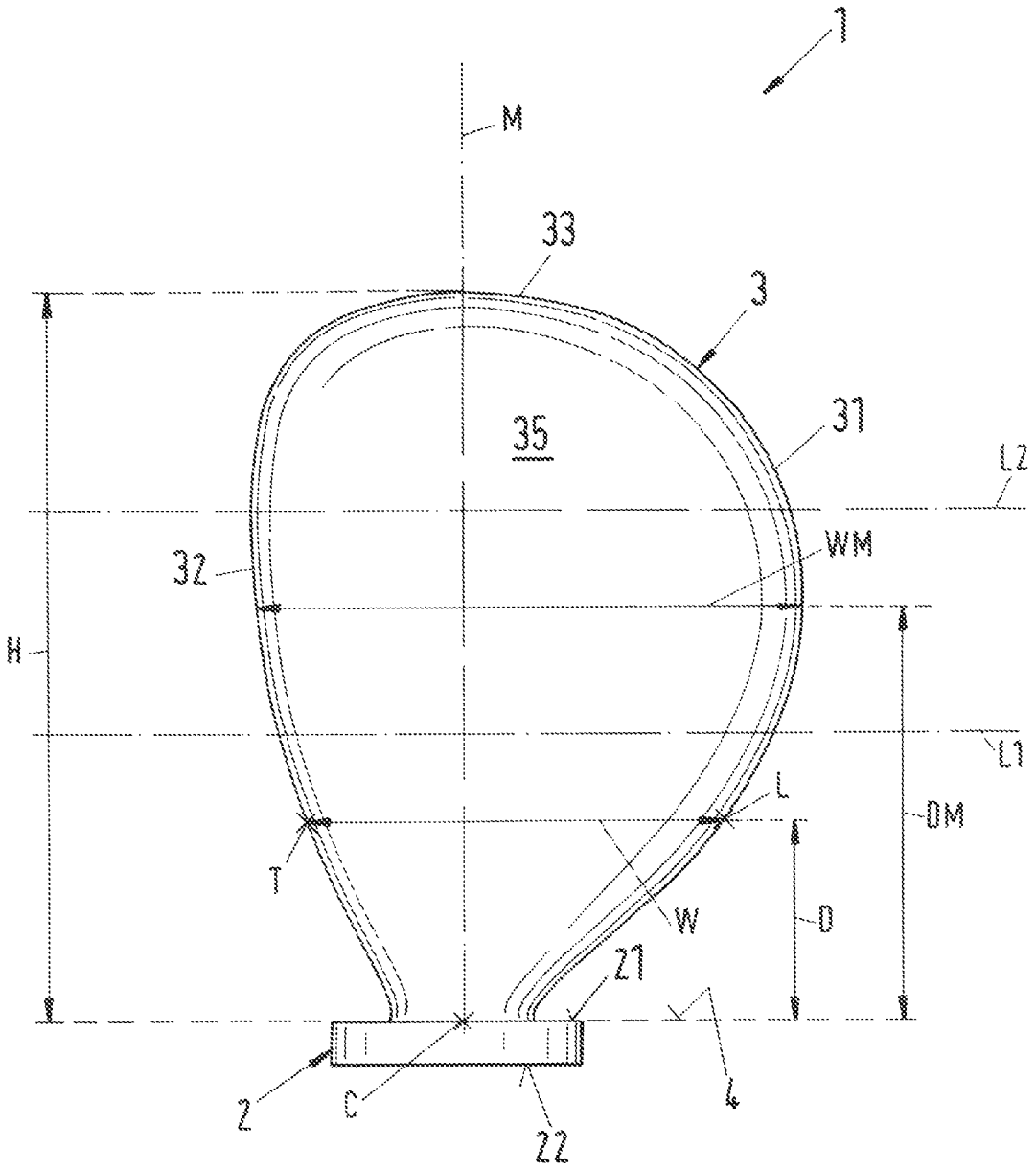
FIG. 4 is a plan view of the embodiment of the vane shown in FIG. 2.
Figure 5:
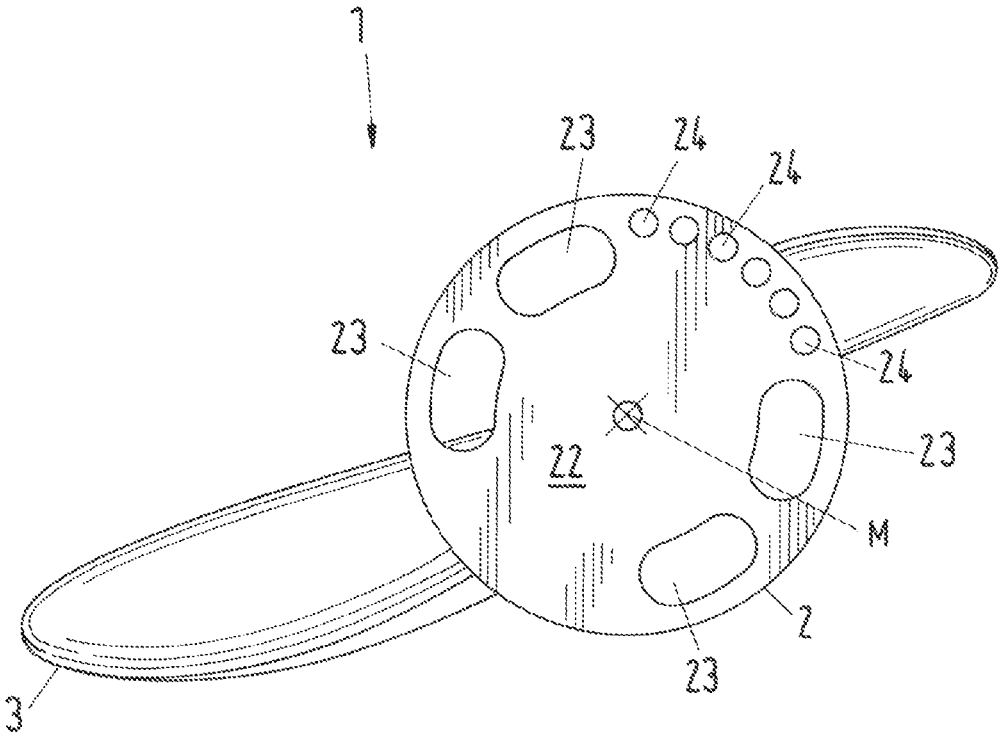
FIG. 5 is a bottom view of the embodiment of the vane shown in FIG. 2.

As can be best seen in FIG. 4, starting from the upper surface 21 of the socket 2 the width W of the blade 3 is first increasing with increasing distance D from the base plane 4, reaches a maximum width WM and then decreases with further increasing distance D towards the blade tip 33.

According to the invention the maximum width WM of the blade 3 is at least 55 percent and preferably at least 65 percent of the height H of the blade 3. The optimum value for the maximum width WM depends on the respective application as well as on the absolute value of the height H of the blade 3. For many embodiments of the blade 3 it is even preferred when the maximum width WM is at least 70 percent and preferably at least 75 percent of the height H.

In the embodiment shown in FIG. 4 the maximum width WM of the blade 3 is approximately 80% of the height H of the blade.

The considerable maximum width WM of the blade 3 as compared to its height H ensures a high efficiency as well as reliable operation and very good process results when the blade 3 is used in an agitator 100.

Preferably, the maximum width WM of the blade 3 is located at a distance DM from the base plane 4 that is between 40 percent and 70 percent of the height H of the blade 3. This region of 40% to 70% of the height H is in FIG. 4 delimitated by the lines L1 and L2. For most applications it is preferred when the maximum width WM is located at a distance DM from the base plane 4 which is between 50% and 60% of the height H of the blade 3, i.e. the maximum width WM is preferably located in the upper half of the blade 3 (relating to the representation in FIG. 4). The height H of the blade 3 shown in FIG. 4 is for example approximately 340 mm and the maximum width WM is located approximately at 57% of the height H.

A further preferred measure is the embodiment of the leading edge 31 and the trailing edge 32 as seen in the plan view of FIG. 4. In this projection into a plane perpendicular to the base plane 4 the blade 3 has a generally biconvex shape—apart from the very small region immediately adjacent to the upper surface 21 of the socket 2. This means, both the leading edge 31 and the trailing edge 32 are outwardly cambered, i.e. both edges 31 and 32 are convex essentially over their entire length.

For the sake of clearness it shall be mentioned that the terms "convex" and "concave" are used with their common meaning, i.e. a surface of a body is called concave, if the surface is curved inwardly with respect to the body and a surface is called convex, if the surface is curved outwardly with respect to the body.

Figure 6:
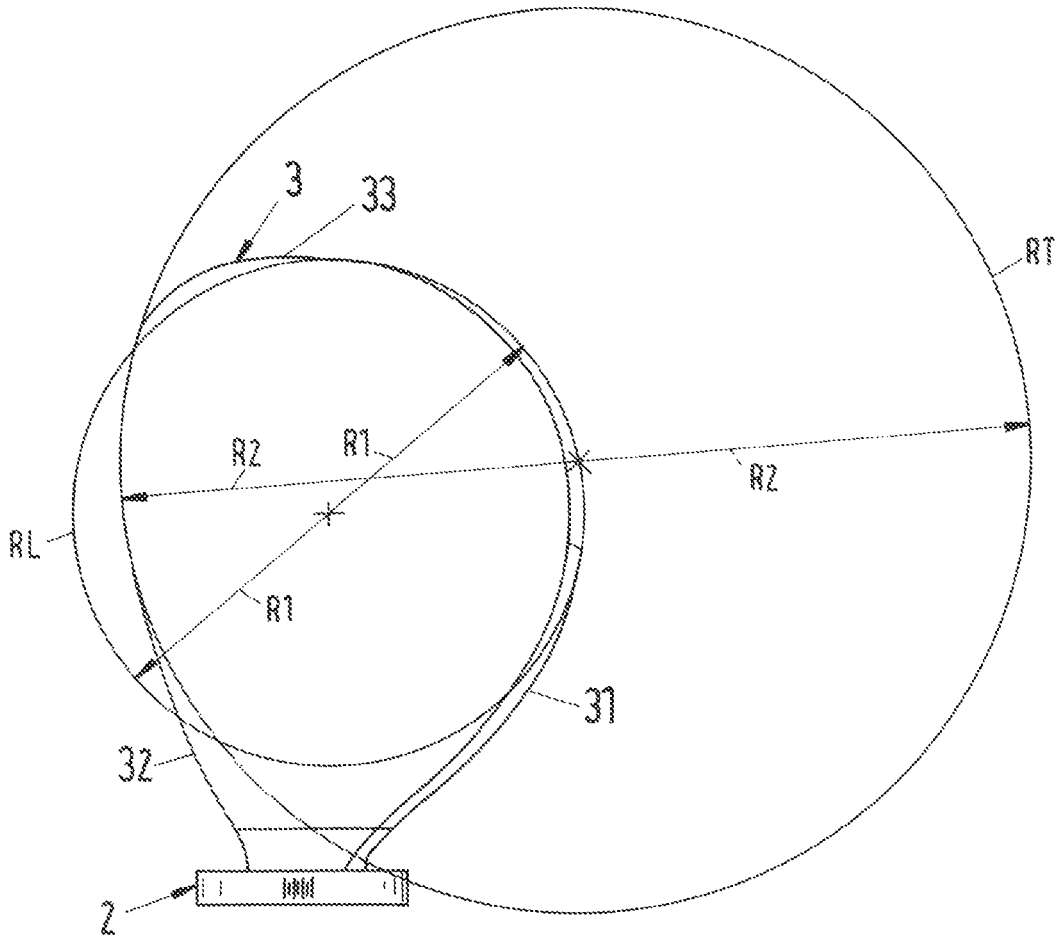
FIG. 6 is a plan view similar to FIG. 4, illustrating the main curvatures of the leading edge and the trailing edge, respectively.

As can be best seen in FIG. 4 the main curvature of the leading edge 31 is larger than the main curvature of the trailing edge 32, that is the leading edge 31 is stronger curved than the trailing edge 32. To explain the meaning of the term 'main curvature' reference is made to FIG. 6 showing a plan view of the blade 3 similar to FIG. 4. Although the curvature both of the leading edge 31 and of the trailing edge 32 does not change its respective algebraic sign, the curvatures are not constant over the entire length of the respective edge 31, 32. However, it is possible to approximate the curvature of the leading edge 31 by a circle RL having the radius R1 whereupon R1 is chosen as the maximum value of the radius of a circle that still fits the curvature of the leading edge. In the same manner the curvature of the trailing edge 32 is approximated by a circle RT having the radius R2. The respective radius R1 or R2 is then considered as the main curvature of the leading edge 31 or the trailing edge 32, respectively. The smaller the radius R1, R2 is, the stronger is the curvature of the respective edge 31, 32. The preferred ratio between the main curvature R1 of the leading edge 31 and the main curvature R2 of the trailing edge 32 is such that the main curvature R2 of the trailing edge 32 is at least 1.5 times and preferably at least 1.8 times the main curvature R1 of the leading edge 31. In the embodiment shown in FIG. 4 or FIG. 6 the ratio R2/R1 is approximately 1.8. The radius R1 of the main curvature of the leading edge 31 is approximately 140 mm.

Figure 7:
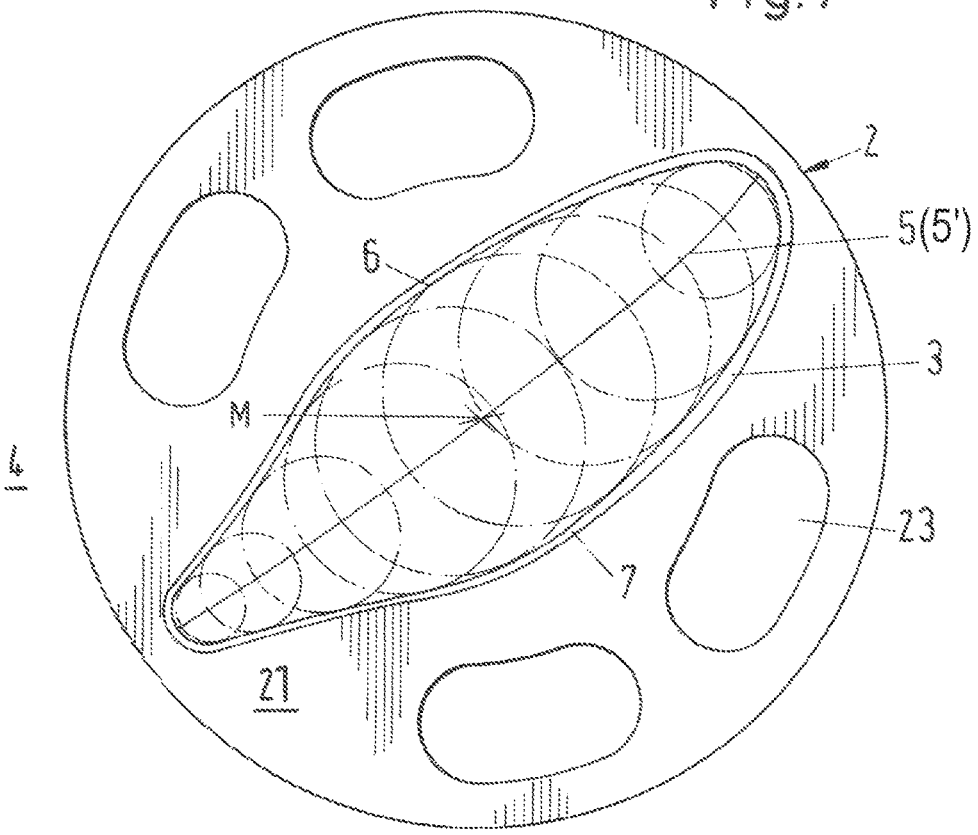
FIG. 7 is a profile of the blade of the vane shown in FIG. 2 in a cross-section parallel to the base plane and near the socket of the vane.
Figure 8:
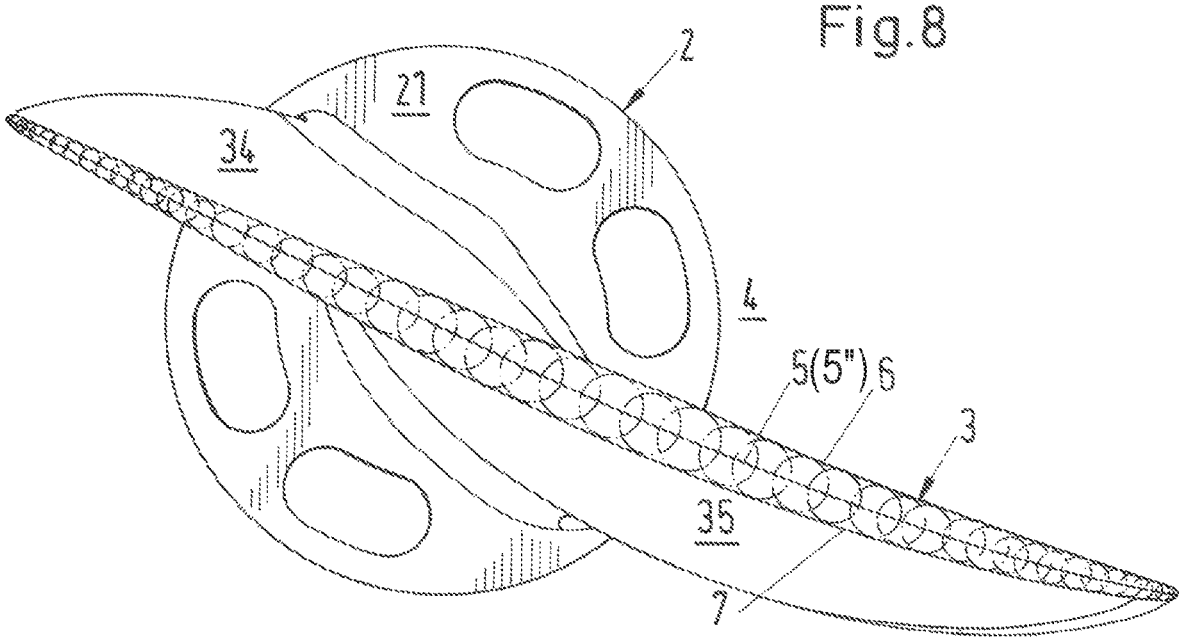
FIG. 8 is a profile similar to FIG. 7, but near half the height of the blade.
Figure 9:
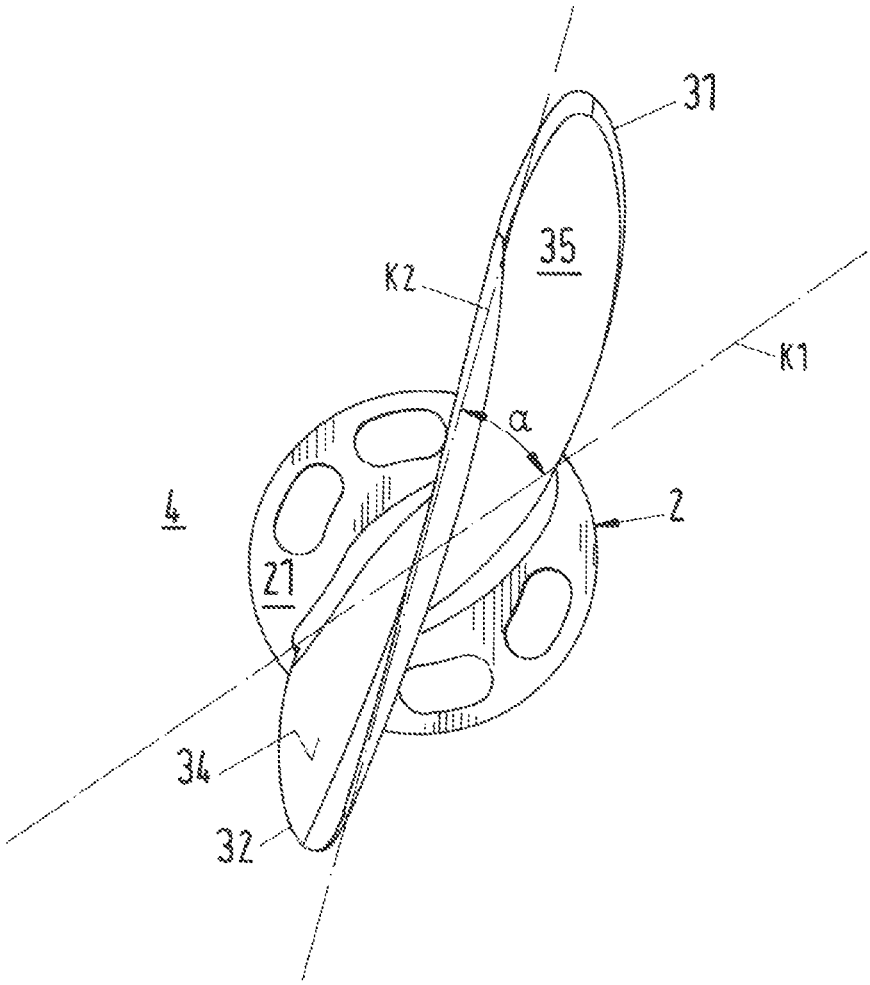
FIG. 9 is a profile similar to FIG. 7, but near the blade tip of the blade.

As can be best seen in FIG. 3 the blade 3 is twisted around the main axis M. This twisting of the blade 3 may be described by a camber line of different profiles of the blade 3. Each profile is a cross-section through the blade 3 in a plane parallel to the base plane 4, i.e. perpendicular to the main axis M. FIG. 7-9 show three different profiles taken at different distances D from the base plane 4. FIG. 7 shows the profile of the blade 3 very close to the base plane 4 in a distance D which is less than 1% of the height H. FIG. 8 shows the profile of the blade 3 at a distance D that is approximately half of the height H and FIG. 9 shows the profile of the blade 3 near the blade tip 33 at a distance D of approximately 90% of the height H. Each profile is laterally delimited by a first border line 6 and a second border line 7.

In FIG. 7 and in FIG. 8 the camber line 5 of the respective profile is shown. The camber line 5 is the center line of the profile having at each point the same distance from both border lines 6, 7. As indicated in FIG. 7 and in FIG. 8 the camber line 5 may be determined by inscribing circles into the profile, each circle touching both the first and the second border line 6, 7. The camber line 5 is then obtained by connecting the centers of the circles.

As can be seen by comparing especially FIG. 7 and FIG. 8 the camber line 5 is turning counterclockwise around the main axis M with increasing distance D from the base plane 4, which demonstrates the twisting of the blade 3 around the main axis M.

As can be also seen in FIG. 7 and FIG. 8 the camber line 5 is not a straight line but curved. At least for some profiles the camber line 5 changes the algebraic sign of its curvature, i.e. the camber line 5 comprises a part with positive curvature and a part with negative curvature.

For quantifying the twisting of the blade 3 around the main axis M the mean direction of the respective camber line 5 may be considered. The mean direction of the camber line 5 means that direction in which the camber line 5 is mainly extending. The mean direction may be determined for example by approximating the respective camber line 5 by a straight line.

FIG. 9 shows the mean direction of the camber line 5 of two different profiles. The mean direction of the camber line 5 (first camber line 5') of the profile shown in FIG. 7 is denoted with K1 and the main direction of the camber line 5 of the profile shown in FIG. 9 is denoted with K2. That is, main direction K1 belongs to the profile adjacent to the socket 2 (FIG. 7) and the main direction K2 belongs to the profile near the blade tip 33. The main directions K1 and K2 delimit a twist angle $\alpha$, describing the twisting of the blade around the main axis M. The twist angle $\alpha$ is determined in the base plane 4, i.e. the main directions K1 and K2 are projected on the base plane 4.

Preferably, the twist angle $\alpha$ between the mean direction K1 of the camber line in a profile near the base plane 4 (FIG. 7) and the main direction K2 of the camber line 5 (second camber line 5") in a profile near the blade tip 33 is at least 30°. In the embodiment of the vane 1 shown in FIG. 9 the twist angle $\alpha$ is approximately 40°.

Viewed in a direction perpendicular to the main axis M of the blade 3, the pressure side 34 (see for example FIG. 2 or FIG. 8) of the blade 3 comprises both convex and concave regions. In a middle region around the main axis M the pressure side 34 is convex. Moving towards the leading edge 31 the pressure side 34 becomes concave and moving from the middle region towards the trailing edge 32 the pressure side becomes concave, too, such that the overall shape of the pressure side 34 is concave with a convex region in the middle. As to the suction side 35 the dominating curvature of the suction side 35 is convex. In the region between the leading edge 31 and the main axis M the suction side 35 is convex. In the region between the main axis M and the trailing edge 32 the suction side 35 becomes slightly concave, wherein 'slightly' means that the dominant curvature of the suction side 35 remains convex.

Preferably, the socket 2 of the vane 1 is designed as a flange socket for flange mounting the vane 1 to the hub 51 of the impeller 50 (see FIG. 10) in an adjustable manner, i.e. the relative orientation of the vane 1 with respect to the hub 51 is adjustable.

Referring to FIG. 5 showing a bottom view of the vane 1 the socket 2 comprises a plurality, here four, arcuate oblong holes 23 arranged adjacent to the circumferential rim of the disk shaped socket 2. The oblong holes 23 are positioned pairwise diametrically opposing. Two of the oblong holes 23 are located in front of the pressure side 34 of the blade 3 and two of the oblong holes 23 are located in front of the suction side 35 of the blade 3. Each oblong hole 23 may receive a screw 8 (see FIG. 10) for fasting the vane 1 to the hub 51 of the impeller 50. Due to the arcuate shape of the oblong holes 23 the orientation of the respective vane 1 with respect to the hub 51 may be adjusted. In order to fix the vane 1 in the desired orientation the lower surface 22 of the socket 2 comprises a plurality of blind bores 24 arranged adjacent to the circumferential rim of the disk shaped socket 2 wherein all blind bores 24 have the same distance from the center of the lower surface 22 of the socket 2. The hub 51 of the impeller 50 comprises one positioning pin (not shown) for each vane 1. Upon mounting of the vane 1 to the hub 51 the positioning pin engages one of the blind bores 24, thus fixing the desired orientation of the vane 1.

Figure 10:
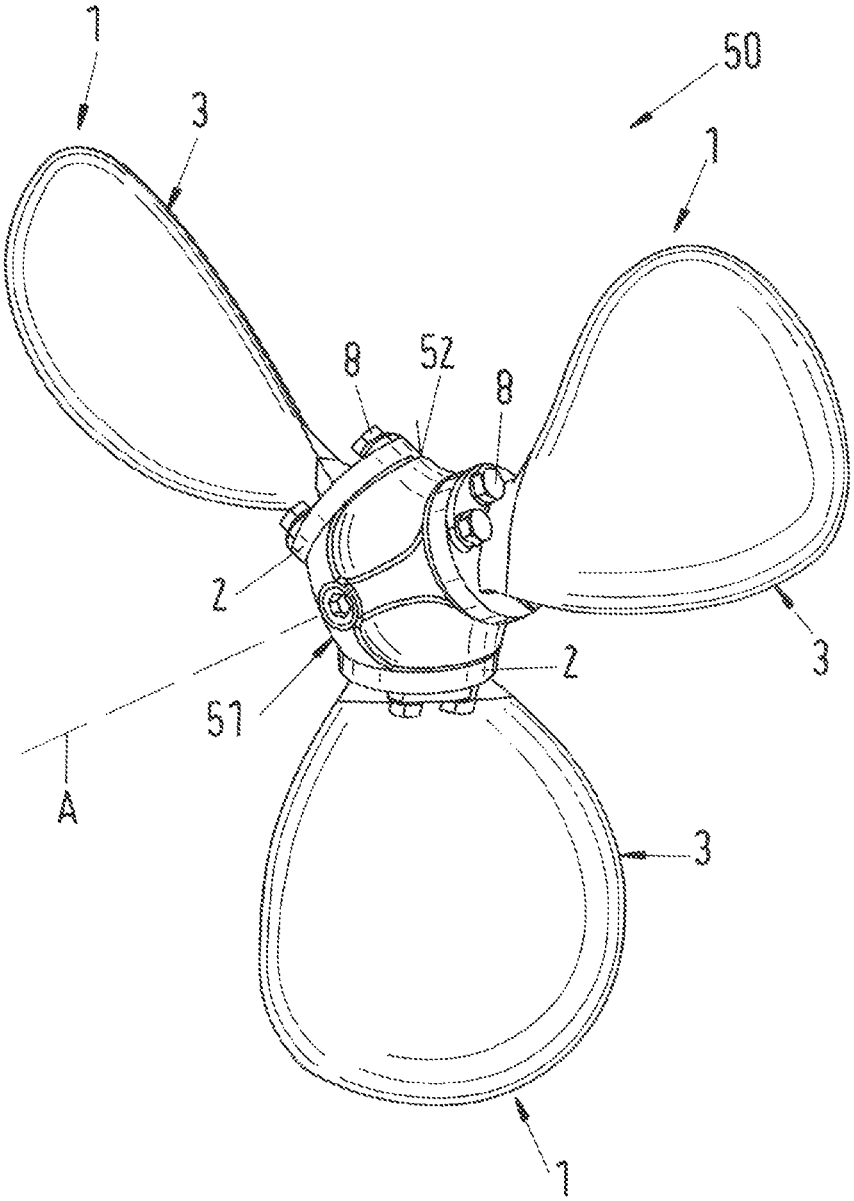
FIG. 10 is a perspective view of an embodiment of an impeller according to the invention.

FIG. 10 shows a perspective view of an embodiment of the impeller 50 according to the invention. The impeller 50 comprises the hub 51 and three identical vanes 1 flange mounted to the hub 51 and fastened by the screws 8. Each of the three vanes 1 is designed as explained hereinbefore. The vanes 1 are arranged equally spaced around the circumference of the hub 51. The hub 51 comprises three planar mounting faces 52 having essentially the same shape and the same dimensions as the lower surface 22 of the socket 2. In the illustration of FIG. 10 the three mounting faces 52 are covered by the sockets 2 of the vanes 1. Each mounting face 52 is arranged parallel to the axis A around which the impeller 50 rotates.

Depending on the specific application the number of vanes 1 of the impeller 50 may be different from three. In other embodiments of the impeller according to the invention the impeller may for example comprise four vanes.

As already explained hereinbefore with reference to FIG. 1 showing an embodiment of the agitator 100 according to the invention the impeller 50 is mounted to one end of the drive shaft 60 of the agitator 100.

Figure 11:
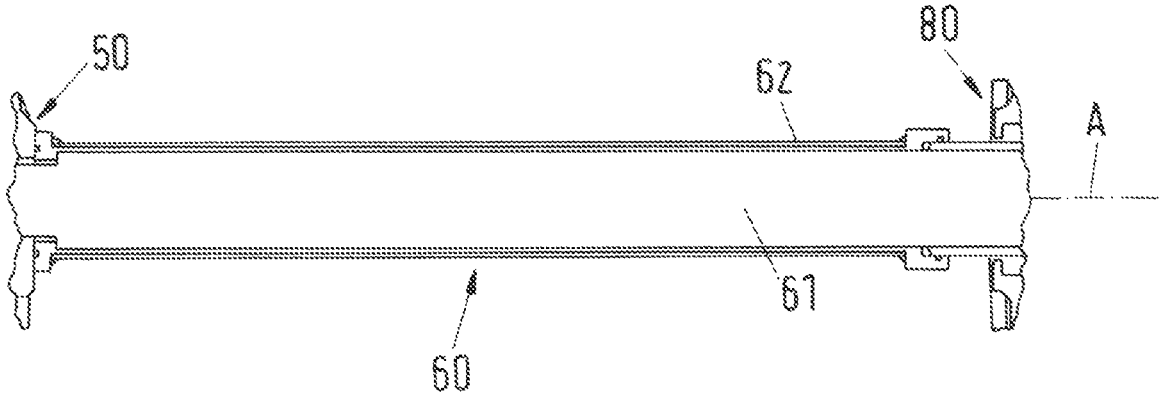
FIG. 11 is a cross-sectional view of an embodiment of the shaft of the agitator shown in FIG. 1.

FIG. 11 shows a preferred embodiment of the drive shaft 60 of the agitator 100 in a cross-sectional view. FIG. 11 only shows the part of the drive shaft 60 between the mounting flange 80 and the impeller 50. The drive shaft 60 comprises an inner shaft 61 extending in the direction of the axis A and a sleeve 62 coaxially surrounding the inner shaft 61 and extending between the impeller 50 and the mounting flange 80. Adjacent to the mounting flange 80 the sleeve 62 is connected to another sleeve which is fixed with respect to the inner shaft 61, for example by a shrink fit. The sleeve 62 is connected both to the sleeve adjacent to the mounting flange 80 and to the impeller 50 in a sealing manner, such that the process fluid cannot enter the sleeve 62. Thus, the sleeve 62 protects the inner shaft 61 against any contact by the process fluid. Such a contact could cause corrosion or other kinds of degradation of the inner shaft 61. Protecting the inner shaft 61 with the sleeve 62 has the advantage that the inner shaft 61 and the sleeve 62 may be manufactured with different, usually metallic, materials, wherein only the sleeve 62 has to be resistant against corrosion or other degradations caused by the process fluid. It is a further advantage that in case of a degradation of the sleeve 62 only the sleeve 62 has to be replaced and the inner shaft may 61 still be used.

Of course in other embodiments the drive shaft 60 may be designed as a bare shaft without the sleeve 62.

What is claimed:

1. A vane for an impeller of an agitator, comprising:

a socket having a base plane configured to mount the vane to an impeller; and a blade configured to mix a process fluid, the blade having a leading edge, a trailing edge, and a blade tip extending from the leading edge to the trailing edge at an end of the blade facing away from the socket, the blade having a pressure side and a suction side, defining a thickness, and the pressure side having a first concave region towards the leading edge, a second concave region toward the trailing edge and a convex region between the first and second concave regions, the thickness between the pressure side and the suction side increasing to at least partially form the convex region.

2. The vane of claim 1, wherein the suction side has a convex region adjacent the leading edge and a convex region adjacent the trailing edge.

3. The vane of claim 1, wherein the blade is connected to the socket in the base plane extending perpendicularly to a main axis of the blade, the blade having a first camber line adjacent the base plane and a second camber line adjacent a tip of the blade, an angle between a mean direction of the first camber line and a mean direction of the second camber line being at least 30 degrees.

4. The vane of claim 3 wherein the blade has a height and a width, the height being the maximum distance of the blade tip from the socket and the width being the distance of the leading edge from the trailing edge, the blade having a maximum width that is at least 55 percent of the height.

5. The vane in accordance with claim 4, wherein the maximum width is at least 70 percent of the height.

6. The vane in accordance with claim 4, wherein the maximum width of the blade is in a region between 40 percent and 70 percent of the height of the blade.

7. The vane in accordance with claim 4, wherein the leading edge extends from the socket to the blade tip with a main curvature that is larger than a main curvature with which the trailing edge extends from the socket to the blade tip.

8. The vane in accordance with claim 7, wherein the main curvature of the trailing edge has a radius that is at least 1.5 times a radius of the main curvature of the leading edge.

9. The vane in accordance with claim 3, wherein the angle between the mean direction of the first camber line and the mean direction of the second camber line is approximately 40 degrees.

10. The vane in accordance with claim 1, wherein the blade includes first and second camber lines and each of the first and second camber lines is curved.

11. An impeller of an agitator for mixing or agitating the process fluid, comprising: a hub; and a plurality of vanes mounted to the hub, each vane is configured according to claim 1, and each vane is mounted to the hub by a respective socket.

* * * * *